US007891598B2

(12) United States Patent
Maddaleni et al.

(10) Patent No.: US 7,891,598 B2
(45) Date of Patent: Feb. 22, 2011

(54) REWINDING MACHINE AND WINDING METHOD FOR THE PRODUCTION OF LOGS

(75) Inventors: Romano Maddaleni, Pisa (IT); Mauro Gelli, Capannori Lucca (IT); Alessandro Borelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 68 days.

(21) Appl. No.: 12/087,897

(22) PCT Filed: Jan. 5, 2007

(86) PCT No.: PCT/IT2007/000010

§ 371 (c)(1),
(2), (4) Date: Aug. 7, 2008

(87) PCT Pub. No.: WO2007/083336

PCT Pub. Date: Jul. 26, 2007

(65) Prior Publication Data

US 2009/0095836 A1 Apr. 16, 2009

(30) Foreign Application Priority Data

Jan. 18, 2006 (IT) ..... FI2006A0014

(51) Int. Cl.
*B65H 19/28* (2006.01)

(52) U.S. Cl. ..... 242/532; 242/532.2; 242/533

(58) Field of Classification Search ..... 242/532, 242/532.2, 542.2, 533, 533.1
See application file for complete search history.

(56) References Cited

U.S. PATENT DOCUMENTS

| | | | | |
|---|---|---|---|---|
| 4,856,725 | A | 8/1989 | Bradley | |
| 5,979,818 | A * | 11/1999 | Perini et al. | 242/521 |
| 6,595,458 | B1 * | 7/2003 | Biagiotti | 242/532.2 |
| 6,648,266 | B1 * | 11/2003 | Biagiotti et al. | 242/521 |
| 6,948,677 | B2 * | 9/2005 | Biagiotti et al. | 242/521 |
| 2005/0087647 | A1 * | 4/2005 | Butterworth et al. | 242/521 |

FOREIGN PATENT DOCUMENTS

| | | | |
|---|---|---|---|
| EP | 1 232 980 | A1 | 8/2002 |
| WO | WO 00/68129 | A1 | 11/2000 |
| WO | WO 2004/005172 | A1 | 1/2004 |
| WO | WO 2004/046006 | A2 | 6/2004 |
| WO | WO 2004/096684 | A2 | 11/2004 |
| WO | WO 2005/054102 | A1 | 6/2005 |
| WO | WO 2005/054104 | A2 | 6/2005 |
| WO | WO 2005/075328 | A1 | 8/2005 |

* cited by examiner

*Primary Examiner*—Sang Kim
(74) *Attorney, Agent, or Firm*—Breiner & Breiner, LLC

(57) ABSTRACT

The rewinding machine includes a path for insertion of tubular cores; a winding cradle; a first moving member designed to be in contact with the web material to be wound; a rolling surface forming, with the first moving member, a channel for passage of the tubular cores; and an insertion device to insert the cores in the channel. At the inlet of the insertion channel there is a second moving member, opposed to the first moving member, the core insertion path passing between the first and the second moving members. The two moving members are arranged at a distance such that a core inserted between them is in contact with the second moving member and with the web material entrained around the first moving member.

40 Claims, 9 Drawing Sheets

1
A
13
41
53
37
61
63
63A
68
61A
67
66
65
51
52
51A
91
93
83
85
86
15
58
55
I
V
X

VII
VII

REWINDING MACHINE AND WINDING METHOD FOR THE PRODUCTION OF LOGS

TECHNICAL FIELD

The present invention relates to improvements in winding or rewinding machines for the production of logs of wound web material, for example but not exclusively paper and tissue paper.

The invention also relates to improvements to the winding methods for the production of logs of web material.

STATE OF THE ART

In the paper converting industry, for example for the production of tissue paper articles in the form of rolls, such as toilet rolls, kitchen paper and the like, so-called rewinding machines are used, which have the function of rewinding a web material, coming from large reels (so-called parent reels), into logs with diameter equal to the diameter of the finished articles which will then be sold. The logs thus obtained are much longer than the axial length of the articles then sold and are therefore cut square to their axis to obtain the finished product which is then packaged.

Winding or rewinding must be performed at high speed and continuously. Winding of one single log requires approximately 1-3 seconds. At the end of winding, the web material is severed, i.e. torn or cut, to create the trailing edge of the finished log and the leading edge of the material which will be wound on the next log. Severing of the web material, discharge of the finished log and the beginning of winding of the next log are called exchange phase or operation. Said operation is performed, in modern machines, without interrupting or slowing down the feed of the web material, in order not to reduce hourly throughput.

Winding is normally performed around tubular winding cores, on which the leading edge of the web material is made to adhere by means of an adhesive applied on the tubular core, or by means of suction inside the tubular core which, in said case, has apertures on its cylindrical surface. In other embodiments the tubular cores are electrostatically charged to attract the free leading edge of the web material.

The modern rewinding machines are provided with a winding cradle, wherein winding cradle is understood as a complex of motor-driven parts which maintain contact with the outer surface of the log during the formation phase and transmit the winding movement to the log, if necessary assisted by axial winding systems. These rewinding machines are commonly defined surface rewinders.

U.S. Pat. No. 5,979,818 describes a surface rewinder machine comprising: a path for insertion of said tubular cores; a winding cradle; a moving member designed to be in contact with the web material to be wound; a rolling surface forming with said moving member a channel for the passage of said tubular cores, extending towards an inlet nip in said winding cradle; an insertion element for inserting said cores into said channel. When a new core has to be inserted in the machine to begin winding of a new log, it is pushed into the channel between a moving member and a rolling surface. The moving member can be a winding roller forming part of the winding cradle, or a belt or other moving member in contact with the web material. A severing device, which operates in an intermediate position along the channel for passage of the cores, cuts or severs the web material, forming a leading edge and a trailing edge.

U.S. Pat. No. 5,769,352 discloses an improvement to this type of rewinding machine, which allows for the use of winding cores with substantially different diameters by means of a simple adjustment. For said purpose the rolling surface that forms the channel for insertion and passage of the cores consists of two portions: a first oscillating portion defining the first section of the channel and a second fixed portion, terminating at the level of a nip between a first and a second winding roller.

Rewinding machines provided with a channel for passage of the cores and specific systems for severing the web material and beginning winding thereof on the new core are furthermore described in WO-A-2005/054102; WO-A-2005/054104; WO-A-2005/075328. In these machines the channel for passage of the cores is always defined between a rolling surface and a moving member, typically a belt or a series of belts positioned side by side.

WO-A-00/68129 describes a rewinding machine with a structure similar to the one disclosed in U.S. Pat. No. 5,979,818, provided with a suction system, with one or two inlets that interface with the ends of the tubular winding cores, to generate a vacuum inside the cores and wind the first turn of web material around said core due to the suction through holes or apertures on the cylindrical surface of the cores. The suction inlets are fitted on a moving device to follow the winding cores along part of their insertion path towards the winding cradle, in order to have enough time to induce winding of the first turn of web material.

WO-A-2004/096684 discloses a rewinding machine in which the cores are inserted again into a channel delimited between a rolling surface and a winding roller. In this case, the web material is severed by a system of jets of compressed air, as already known in the state of the art.

WO-A-2004/005172 describes a rewinding machine with a channel for passage or insertion of the cores, defined between a partially sucking winding roller and a rolling surface. An element for severing the web material is provided to act on the web material upstream of inlet of the core insertion channel.

Some operating problems or limits can be encountered in the rewinding machines known so far. For example, when using a system for starting winding by means of suction, suction inlets must be provided which follow the movement of the tubular winding cores for a long stretch (WO-A-00/68129), and this entails some mechanical complications.

Furthermore, when a mechanical system is used for severing the web material, it may be necessary to prevent the tubular core from knocking against the severing mechanism, which is often moved forward more slowly than the web material. This need limits the flexibility of the rewinding machine.

In some known rewinding machines, with an insertion channel for the winding cores and a device for severing the web material acting in an intermediate position along said channel, there is the drawback that the web material is severed at a point relatively far from the point where the web is attached to the new winding core, thus forming a particularly long folded leading edge.

Furthermore, when the winding core is inserted in a channel defined between a winding roller, or other moving member, and a fixed rolling surface, said core is subject to a sudden angular acceleration and therefore to a high level of stress. The initial angular acceleration phase cannot be reliably controlled.

When the winding core is accelerated angularly due to the simultaneous contact between a winding roller (or other moving member onto which the web material is guided) and a fixed rolling surface, the forward movement of the winding core depends directly on the diameter of the core itself, hence the larger the diameter of the core, the longer the insertion channel will have to be. If the machine is intended for operation with tubular cores of variable diameter, the diameter variation range is limited, as the insertion channel must be of an appropriate length for cores with larger diameter. This imposes limits on the versatility of the rewinding machine. Alternatively it is necessary to modify the insertion channel and therefore the geometry of the machine, consequently incurring costs.

OBJECTS AND SUMMARY OF THE INVENTION

An object of the present invention is to provide a machine and a method that overcome at least partly the above-mentioned drawbacks and/or limits.

Substantially, according to a first aspect, the invention concerns a rewinding machine for winding a web material in logs around tubular cores, including: a path for insertion of said tubular cores; a winding cradle; a first moving member designed to be in contact with the web material to be wound; a rolling surface, forming with said moving member a channel for the passage of said tubular cores, extending towards a winding cradle-inlet nip; and an inserter for inserting the tubular winding cores into the channel. Characteristically, at the inlet of said insertion channel a second motor-driven moving member is provided, typically a motor-driven roller, opposed to the first moving member, the core insertion path passing between the two moving members which have surface speeds such as to cause an angular acceleration and forward movement of the individual tubular winding cores towards and into the core channel.

In practice, the invention is based on the concept of controlling the forward movement and angular acceleration of the core during insertion into the channel, bringing it simultaneously into contact with two motor-driven moving members so that the angular acceleration of the core is more gradual and the forward movement of its axis can be more accurately controlled. This offers a series of advantages including: more gradual acceleration and therefore reduced mechanical stress on the tubular winding core; more gradual forward movement with consequent possibility of modulating the feed and modifying the law of insertion of the cores; linear forward movement of the core axis not rigidly dependent on its diameter, with consequent possibility of inserting also large diameter cores in a channel of limited length, without the need to modify the geometry of the machine; the possibility of winding one or more turns of web material around the core while the latter moves forward a short distance. This latter possibility is particularly useful (as will be seen below) when the leading edge of the web material to be wound is made to adhere to the winding core by suction through holes provided in the cylindrical wall of the winding core.

The second moving member is preferably a roller rotated by means of an independent motor, a transmission driven by a central motor or by any other suitable means, in particular and preferably with the possibility of intervening by varying the rotation speed cyclically over time during each winding cycle, and/or according to the operating conditions. The term motor-driven roller indicates a cylindrical element or, even more generally, a series of coaxial cylindrical elements, with the same diameter, aligned along one single common rotation axis. However, it should be noted that the second moving member can consist for example of a belt or a set of parallel belts, i.e. one or more continuous elements, moving along a closed path. In any case, the second moving member has, at the point of contact with the tubular winding core, a surface speed (in terms of direction and value) such as to cause a controlled angular acceleration and forward movement of the core.

Preferably, also the first moving member is a roller, which is rotated, and consists preferably of one of the rollers forming the winding cradle. Alternatively, it can consist of a continuous flexible element, like a set of parallel belts entrained around rotating rollers.

Below, specific reference will be made to a roller driven into rotation, i.e. motor-driven, instead of more generically to a second moving member, since this is the preferred embodiment of the invention. It should however be noted that the teaching on which the present invention is based is more general and can be implemented also using moving members different than a motor-driven roller.

The motor-driven roller or other equivalent member can be positioned, with respect to the first moving member onto which the web material is guided, so that the tubular core comes first into contact with the motor-driven roller and only subsequently with the web material. This means that the angular acceleration of the tubular core can be initiated before contacting the web material, thus ensuring a more regular passage of the web material onto the new tubular core. In practice, it is preferably envisaged that the two moving members will rotate in concordant directions. When one or the other or both of said members consist of elements other than rollers, for example continuous belts, by direction of rotation the direction is meant, in which they move forward along the closed path defined by said elements.

The motor-driven roller, or other equivalent moving member, permits control of the forward movement speed of the tubular core towards the channel and therefore offers a number of advantages in terms of flexibility and/or construction simplicity of the machine, as will become clear below in the light of an embodiment example.

Further additional features of the machine according to the invention are set forth in the dependent claims.

According to an advantageous embodiment of the invention, upstream of the motor-driven roller along the core insertion path, supports are positioned to temporarily retain the tubular cores, before insertion thereof between said motor-driven roller and the first moving member. These supports can comprise a chute and flexible retaining blades for said tubular cores. This means that the tubular cores can be positioned by gravity and inserted in a correctly timed manner by means of a pusher constituting the core inserter.

In an advantageous embodiment of the invention, the machine comprises at least one suction inlet to create a vacuum inside the tubular cores, cooperating with the ends of said cores, said cores having a cylindrical surface provided with fluid connection apertures towards an internal cavity placed under a vacuum by said suction inlet. However, this does not exclude the machine being provided with other systems for anchoring the free leading edge on the core, for example an electrostatic system, an adhesive application device or other.

The inlets can be fixed or movable. By movable inlet also an inlet is meant, which is provided with an element intercepting an aperture, said element being movable in order to translate or move the position of the suction point.

The inlets can be moved by an independent actuator. However, according to a preferred embodiment of the invention, the inlets are controlled by the core inserter, thus obtaining a high level of construction simplicity and perfect synchronization with the core insertion movement.

The web material-severing element can be designed in any way compatible with the remaining features of the present invention. For example it can be designed according to the teaching of the patent publications mentioned in the introductory part of the description.

The moving member around which the web material is guided and which defines, with the rolling surface, the channel for passage of the cores, can consist of a belt or a set of belts, or preferably of a roller, and in particular one of the winding rollers that form the winding cradle.

According to a different aspect, the invention also concerns a method for winding a web material around tubular winding cores, comprising the steps of: feeding a web material around a moving member; winding a pre-set quantity of web material around a first winding core to form a log; severing the web material at the end of winding of said log, a second winding core being inserted in a channel for passage of the cores, defined between a rolling surface and said moving member. Characteristically, the method of the present invention provides for control of the angular acceleration and forward movement of the second core into the channel, bringing it into contact with the moving member and with a further moving member, for example a rotating motor-driven roller; at the points of contact with said core the moving member and the rotating roller, or other equivalent moving member, having speeds, in terms of magnitude and direction, such as to cause an angular acceleration and forward movement of the winding core. Preferably, at the points of contact with the tubular winding cores said speeds will be oriented in opposite directions.

Further advantageous features and embodiments of the method according to the invention are set forth in the attached claims and will be described in further detail below with reference to an implementation example.

BRIEF DESCRIPTION OF THE DRAWINGS

The invention will be better understood by following the description and the accompanying drawing, which shows a practical non-limiting embodiment of the invention. More specifically.

DETAILED DESCRIPTION OF EMBODIMENTS OF THE INVENTION

Figure 1:
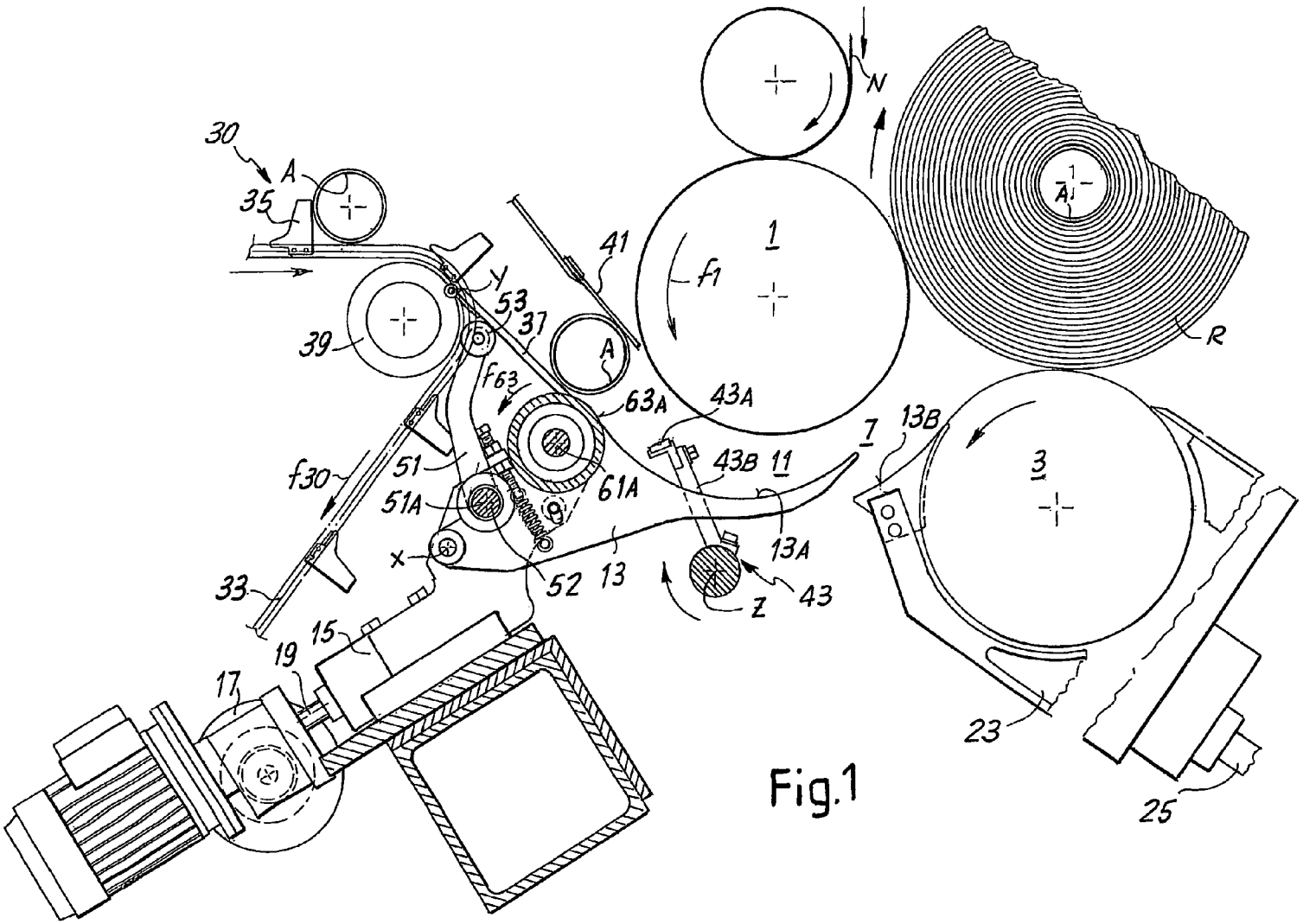
FIG. 1 to 3 show longitudinal sections of the rewinding machine, according to line I-I of FIG. 4, in a work sequence corresponding to an exchange phase of a complete log with a new winding core.

The accompanying drawings show an example of application of the invention to a rewinding machine of the type disclosed in U.S. Pat. No. 5,769,352, but it should be noted that the same inventive concepts can also be applied in rewinding machines of other types, for example (but not exclusively) in machines having the structure described and illustrated in one of the publications mentioned in the introductory part of the present description.

With initial reference to FIGS. 1 to 8, the rewinding machine illustrated in the drawings includes a winding cradle comprising a first winding roller 1, a second winding roller 3 and a third winding roller 5. Between the first and second winding roller 1, 3 a nip 7 is defined through which the web material N to be wound and the tubular winding cores A pass. The third winding roller 5 is supported by a pair of oscillating arms 9 to permit growth of the log R forming in the winding cradle 1, 3, 5.

The web material N, which moves forward at a speed corresponding to the surface speed of the roller 1, is guided around the winding roller 1. Below said roller 1 there is a channel 11 for passage of the winding cores A, which are fed in sequence to the machine. The channel 11 for passage or transit of the cores A is delimited at the top by the cylindrical surface of the winding roller 1 and at the bottom by a rolling surface, formed of two portions indicated by 13A and 13B respectively. The portion 13A consists of a series of curved profiles arranged in a comb-like fashion, parallel to one another and supported by an adjustable slide 15. The position of the slide 15 can be adjusted by means of an actuator 17 and a threaded bar 19. The curved profiles forming the surface 13A are mounted on the slide 15 so as to oscillate around an axis X and are kept close to the roller 1 by means of a traction spring 21, a stop (not shown) being provided to define said position close to the roller. The portion 13B of the rolling surface is formed by comb-shaped profiles supported by a second slide 23, adjustable by means of a similar actuator and a threaded bar 25. The slide 23 also supports the winding roller 3. The profiles forming the portion 13B of the rolling surface terminate in annular grooves of the winding roller 3.

This arrangement—in a per se known manner—permits adjustment of the machine to work with cores of varying diameter.

The winding cores A are fed by a feeder 30 including a chain conveyor 33 with pushers 35. The chain conveyor 33 moves forward in steps or continuously according to the arrow f30 and discharges each individual tubular winding core along a chute 37 formed by a series of parallel profiles connected at one end to an axis Y parallel to the rotation axis of a roller 39 about which the chains 33 are entrained, and at the opposite end to the slide 15. In front of the chute 37 flexible blades 41 are arranged, which define, with the chute 37, a wedge-shaped volume, into which each individual core A wedges, stopping in contact with the ends of the flexible blades 41 and the chute 37, from where it is then pushed as described into the channel 11.

Below the channel 11 is a rotation axis Z around which a severing element 43 for severing the web material rotates, consisting of a series of radial arms 43B terminating in flexible pads 43A. The operation and structure of this severing element are described for example in the U.S. Pat. No. 5,979,818, which should be referred to for further details. It is sufficient here to remember that said severing element pinches the web material N between the pads 43A and the cylindrical surface of the winding roller 1 to cause tearing of the web material N, preferably along transverse perforation lines made previously by a perforation unit (not shown). The tear occurs between the severing element 43 and the log R formed if, in this phase, the severing element moves at a speed lower than the forward movement speed of the web material N, or behind (i.e. upstream on said element if it moves faster than the web material N.

To insert the individual cores A into the channel 11 an inserter is provided comprised of a plurality of oscillating arms 51, each fitted at one end on a shaft 52 oscillating around an axis 51A. At the opposite end each oscillating arm 51 bears an idle roller 53.

The oscillating shaft 52 is supported by the slide 15 and is oscillated, with electronic control, by an actuator 55. The actuator 55, typically an electric servomotor with electronic control, is controlled by a programmable unit, schematically shown at 58, to which also the actuators that control the other mechanical parts of the machine, in addition to the position encoders necessary for the control, are advantageously interfaced.

The slide 15 supports a further motor-driven shaft 61, rotating around an axle 61A, on which a roller 63 is fitted consisting of portions of roller 63A, each fitted on the shaft 61 and combined with a respective oscillating arm 51. The oscillating arms are positioned between the portions 63A of the motor-driven roller 63 so that they can move close to the latter and penetrate, with the ends provided with rollers 53, into the wedge-shaped volume between the chute 37 and the blades 41 towards a nip delimited between the winding roller 1 and the motor-driven roller 63 opposite it. The arrangement is such that each core A which is discharged to the waiting position between the chute 37 and the blades 41, is pushed at the required moment by the oscillating arms 51 into the nip between the roller 1 and the roller 63, said nip having a dimension equal to or preferably slightly smaller than the external diameter of the core.

The shaft 61 is rotated at the required speed by means of an actuator 65, typically an electric motor with electronic control controlled by the unit 58.

Operation of the machine described so far is as follows (see sequence in FIGS. 1-3): while in the winding cradle 1, 3, 5 a log R is forming around a first winding core A, a second winding core A discharged by the conveyor is placed in the waiting position (FIG. 1), in contact with the chute 37 and with the flexible blades 41. The severing element 43 begins to move to make contact with the web material N and pinches it against the roller 1 at the required speed, for example with the pads 41A which move at a speed of between 30% and 70% of the surface speed of the winder roller 1.

Figure 2:
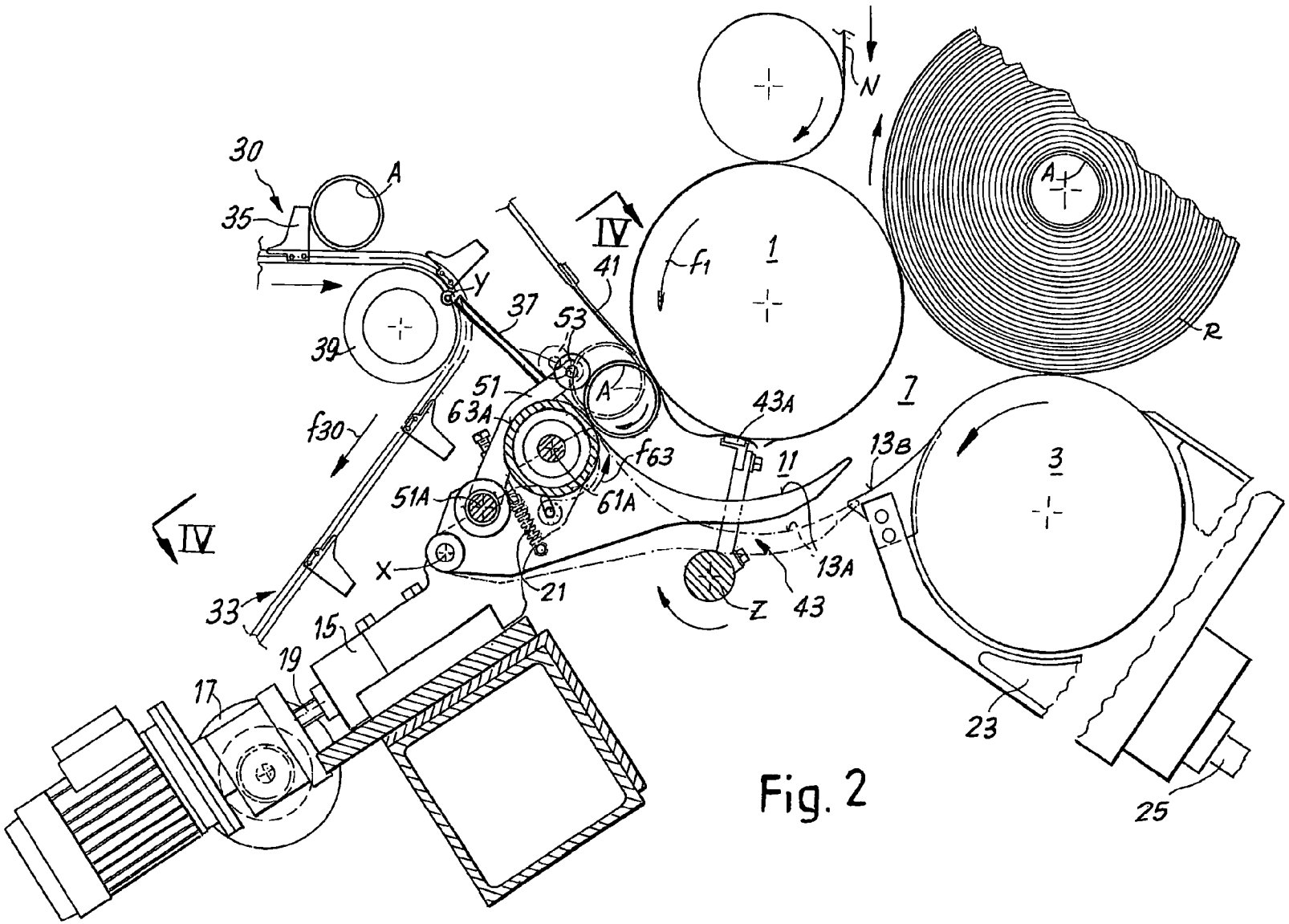

At the appropriate moment the inserter formed by the arms 51 is activated and gradually pushes the waiting tubular core in the nip between the roller 63 and the winding roller 1 (FIG. 2). The surface speed of the roller 63 (arrow f63) at the point of contact with the new core A is oriented in the opposite direction with respect to the surface speed (arrow f1) of the roller 1 at the point of contact with the core (i.e. at the point where the web material N is nipped between the roller 1 and the core A). In short, as indicated by the arrows in the drawing, the rollers 63 and 1 rotate in concordant directions, so that at the points of contact with the new core, the speeds are oriented in opposite directions. The surface speed of the roller 63, furthermore, is lower than the surface speed of the roller 1, so that the centre of the core A moves forward in the nip between the roller 63 and the roller 1 at a speed equal to half the difference between the two surface speeds of the rollers 1 and 63. This forward movement can be performed in a controlled manner by acting on the rotation speed of the motor-driven shaft 61. For example, initially the surface speeds of the two rollers 1, 63 can be equal. The effect of this is that the forward movement of the core towards the channel 11 is much more gradual and slower than in the known machines. In particular, the forward movement is slower than the speed of the web material. Provision can be made (if the surface speeds of the elements 1, 63 are initially the same) for the core to remain with its axis in a set position before beginning to move forward in the channel. It is also possible to arrange the flexible blades 41, the roller 63 and the chute 37 in positions so that the core begins to touch the roller 63 before touching the web material N entrained around the winding roller 1, hence the core A, held at the back by the rollers 53 of the insertion unit, is angularly accelerated before touching the web material N.

When the core touches the rolling surface 13A, it begins to move forward in the channel 11 by rolling in the usual manner, as in the machines of known type.

The first advantage of this way of inserting the core in the channel 11 towards the nip 7 is that the risk of collision with the severing element 43 is lower and the machine is more flexible. The area in which the web material is torn or severed can be nearer the new core and therefore winding begins more regularly.

Gradual insertion of the core is advantageous in any case even without a severing system 43 of the type illustrated in this embodiment example, for example using a system 43 that rotates at a speed higher than the forward speed of advancement of the web material, or also a severing system without an element 43, such as a system which causes severance by acceleration of the third winding roller 5, if necessary in combination with or alternatively to a system of compressed air nozzles that form an air knife, as known to those skilled in the art.

Furthermore, by minimizing the difference in surface speed between the winding roller 1 and the motor-driven roller 63 for insertion of the cores, a considerable quantity of web material can pass through while the winding core with its centre moves forward a short distance. This permits simplification of operation of the machine with a system of suction inlets that act on the ends of the core, since said inlets have to move very little or (in certain cases) could even remain at a standstill while the core is inserted. In fact, the suction applied by the inlets while the core moves slowly forward into the nip between the rollers 1 and 63 lasts long enough to begin winding of the leading edge and to form a first turn around the core, without the latter moving too far away.

Figure 3:
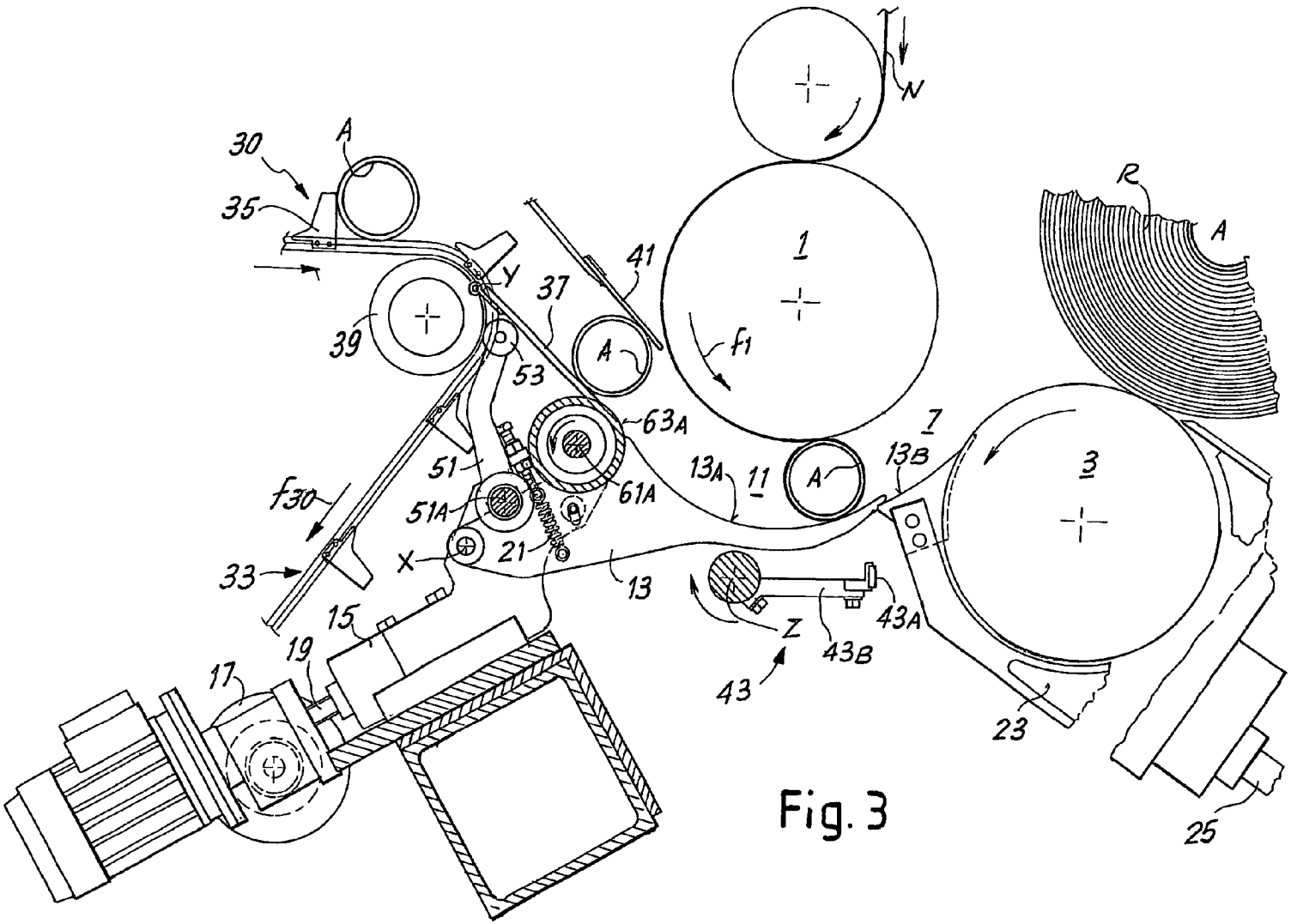
Figure 4:
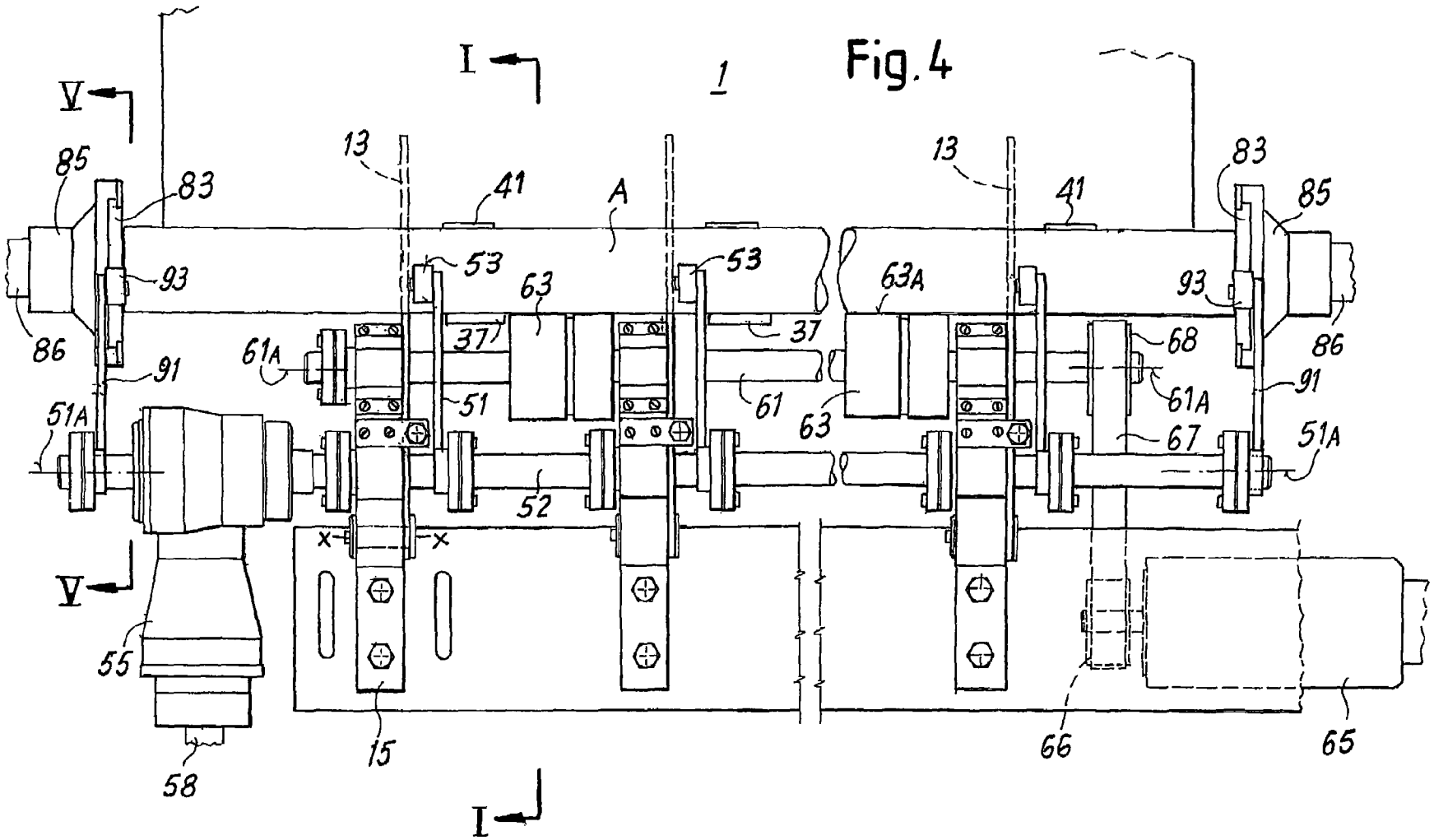
FIG. 4 shows a view approximately according to line IV-IV of FIG. 2.

The embodiment illustrated in the drawing provides for a suction system, omitted in FIG. 1 to 3 but illustrated in FIGS. 4, 5, 6, 7. Said system comprises a pair of suction inlets indicated as a whole by 81, one on each side of the machine. Each suction inlet is provided in the form of a substantially circular aperture in a slider 83, sliding in the direction of the double arrow f83 in a guide formed by a respective fixed guide element 85. The fixed guide element 85 is connected to a suction duct 86 and is provided with a slotted aperture 87, elongated in the direction of movement f83 of the slider 83.

The slider 83 is pushed by compression springs 90 housed in seats provided in the slider and acting on stems 92 integral with the fixed guide element 85. The compression springs 90 push the slider 83 towards an initial position (FIG. 5) corresponding to the position of the tubular winding core before being pushed by the inserter into the narrow passage between the winding roller 1 and the motor-driven roller 63.

The movement of the slider 83 according to the arrow f83 is synchronized with the passage of the core A into the nip between the rollers 63 and 1 by means of a corresponding arm 91 fitted on the oscillating shaft 52, said arm 91 being provided at its free end with an idle roller 93 which acts as a feeler on the edge 83A of the slider 83.

Figures 5, 6, 7:
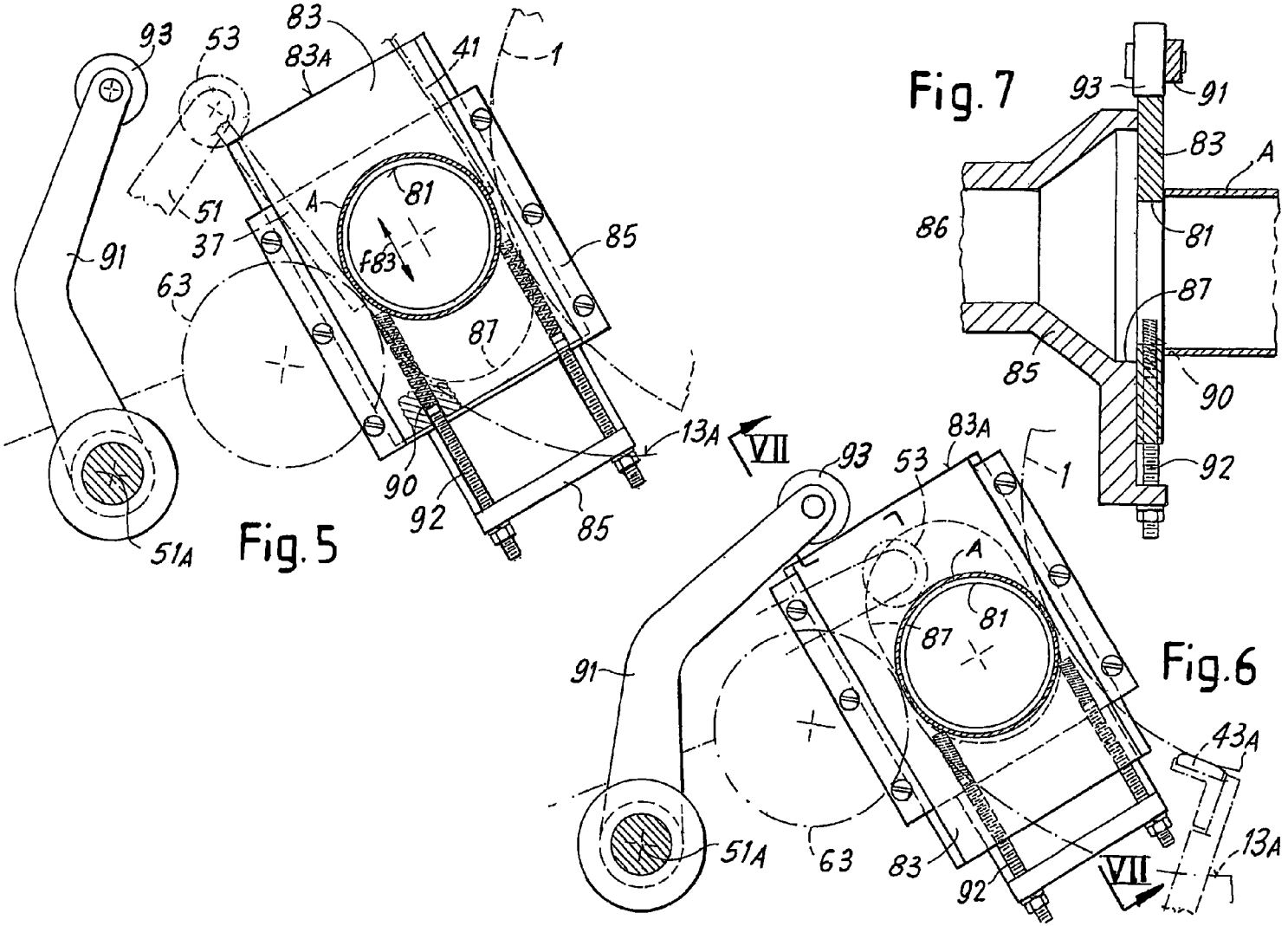
FIGS. 5 and 6 show sections according to line V-V of FIG. 4 in two different operating conditions during the exchange phase.
FIG. 7 shows a local section according to VII-VII of FIG. 6.
Figure 8:
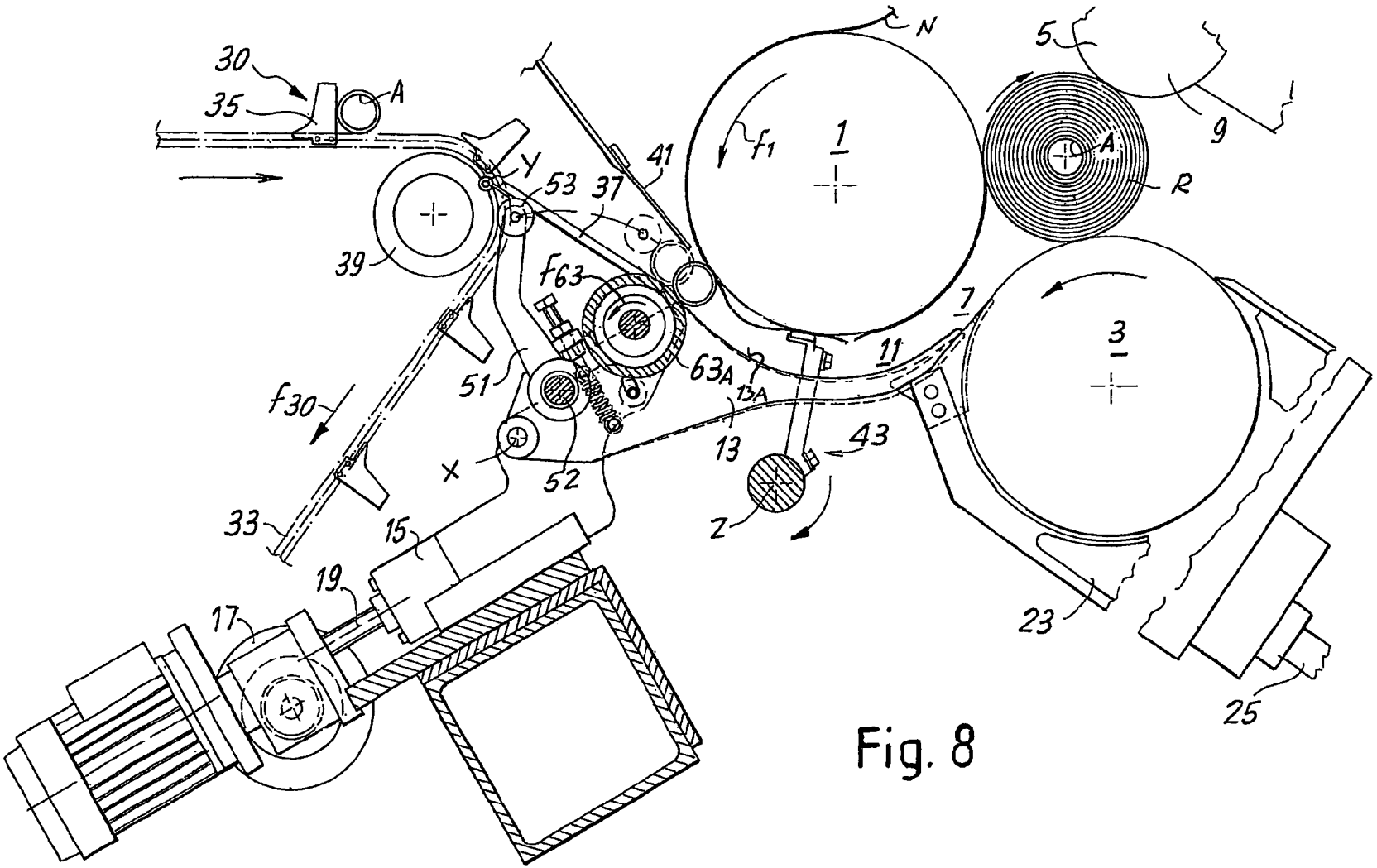
FIG. 8 shows a figure analogous to FIG. 1, of the machine adjusted to work with tubular winding cores of smaller diameter.

Therefore, oscillation of the shaft 52 also causes, in addition to insertion of the winding core in the nip between the rollers 1 and 63, a forward movement of the suction inlet 81 in the direction f83, towards the position of FIG. 6, which constitutes the maximum forward movement position. The position of FIG. 5 corresponds to a position of the core of FIG. 1, while the position of FIG. 6 corresponds to the position the core assumes in FIG. 2 or even further forward in the channel 11.

In this way a very simple forward movement of the suction inlet synchronized with the passage of the tubular core is obtained. Due to the surface speed of the rollers 1 and 63, described above, the time the tubular core remains fluid-connected to the suction inlets 81 is sufficient to initiate winding of the leading edge of the web material, due to the suction exerted through apertures or through holes in the cylindrical wall of the tubular winding core, even though the suction inlet 81 remains substantially still. In effect its forward movement is limited to the stroke of the slider 83, during which the inside of the tubular core is connected to the suction duct 86 via the suction inlet 81 and the elongated aperture 87, the longitudinal extension of which is sufficient to maintain said fluid connection for an adequate forward movement distance of the axis of the tubular winding core, during which the core rotates around its axis far enough, for example, to form a turn of web material.

Between the insertion of two successive winding cores, the suction through the duct 86 can be closed by means of a solenoid valve, opening and closing of which is synchronized with the movement of the winding cores. When the winding cycle of each log R is particularly short, for example for the production of rolls of kitchen paper or toilet rolls for domestic use, the suction can be continuous, while it is advantageous for it to be interrupted when logs with larger diameter are produced, for example for industrial use. In the first case, in fact, the winding cycle (and therefore the frequency with which the tubular cores are inserted) can be 2-3 seconds, while in the second case the winding times of one single log can increase from 5 to as much as 30 seconds or more. In said case it is therefore advantageous, also in order to reduce energy consumption and the noise generated by the machine, to interrupt the suction via the suction inlets 81 when said suction is not required.

Figure 9:
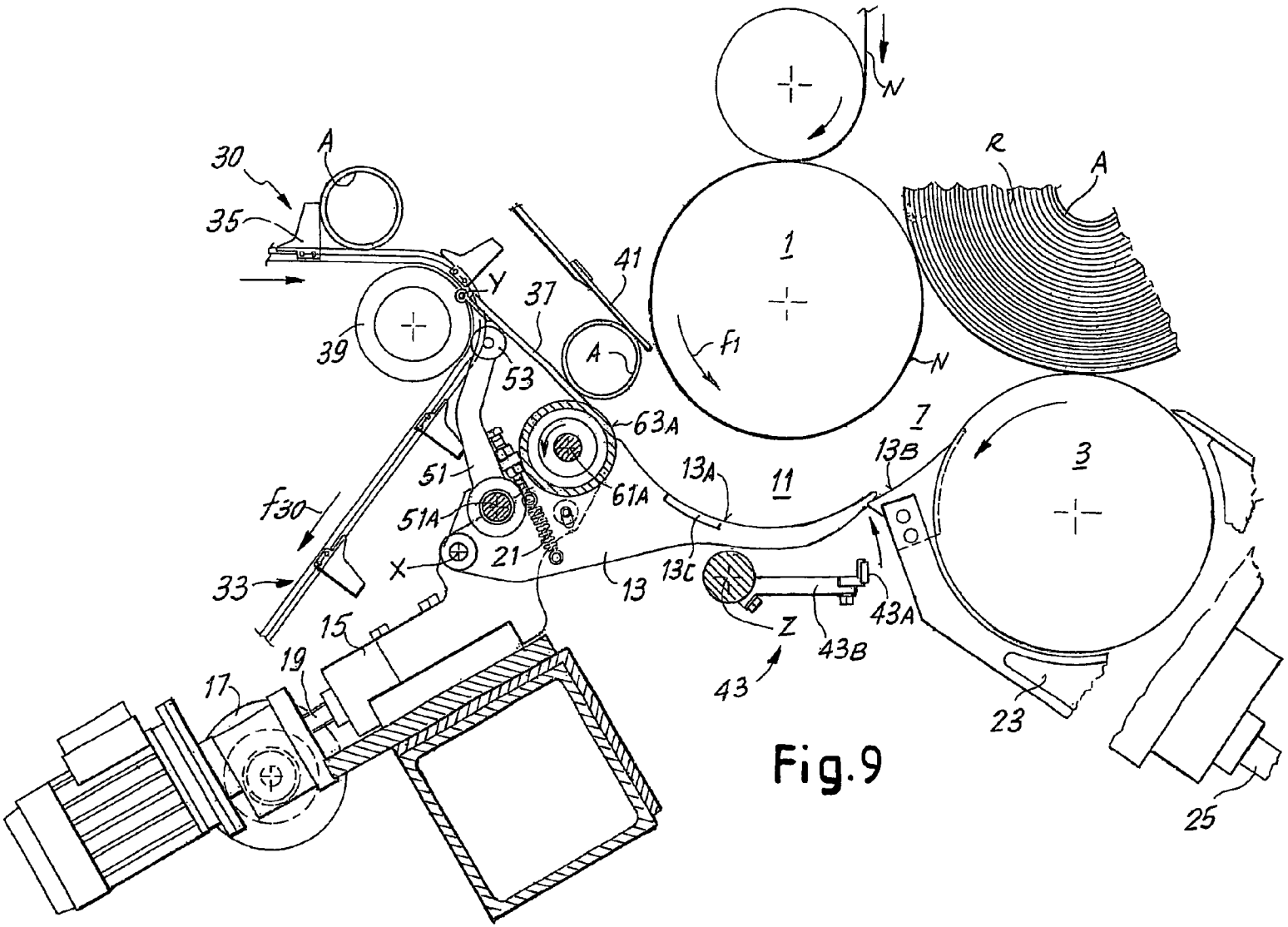
FIG. 9 to 11 show a modified embodiment of the invention, in the exchange phase, i.e. a phase of insertion of a new winding core and severing of the web material, upon completion of a log.
Figure 10:
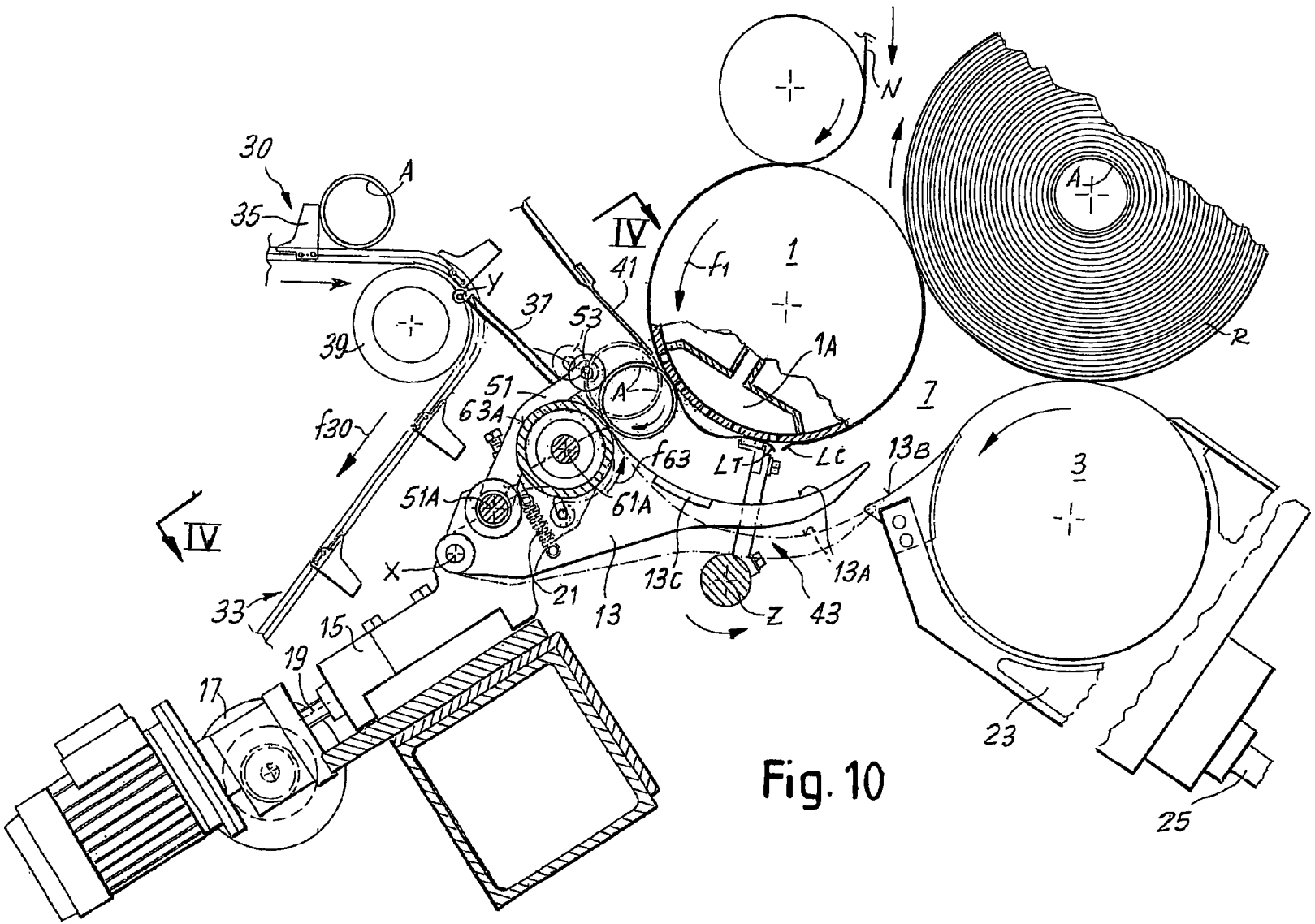
Figure 11:
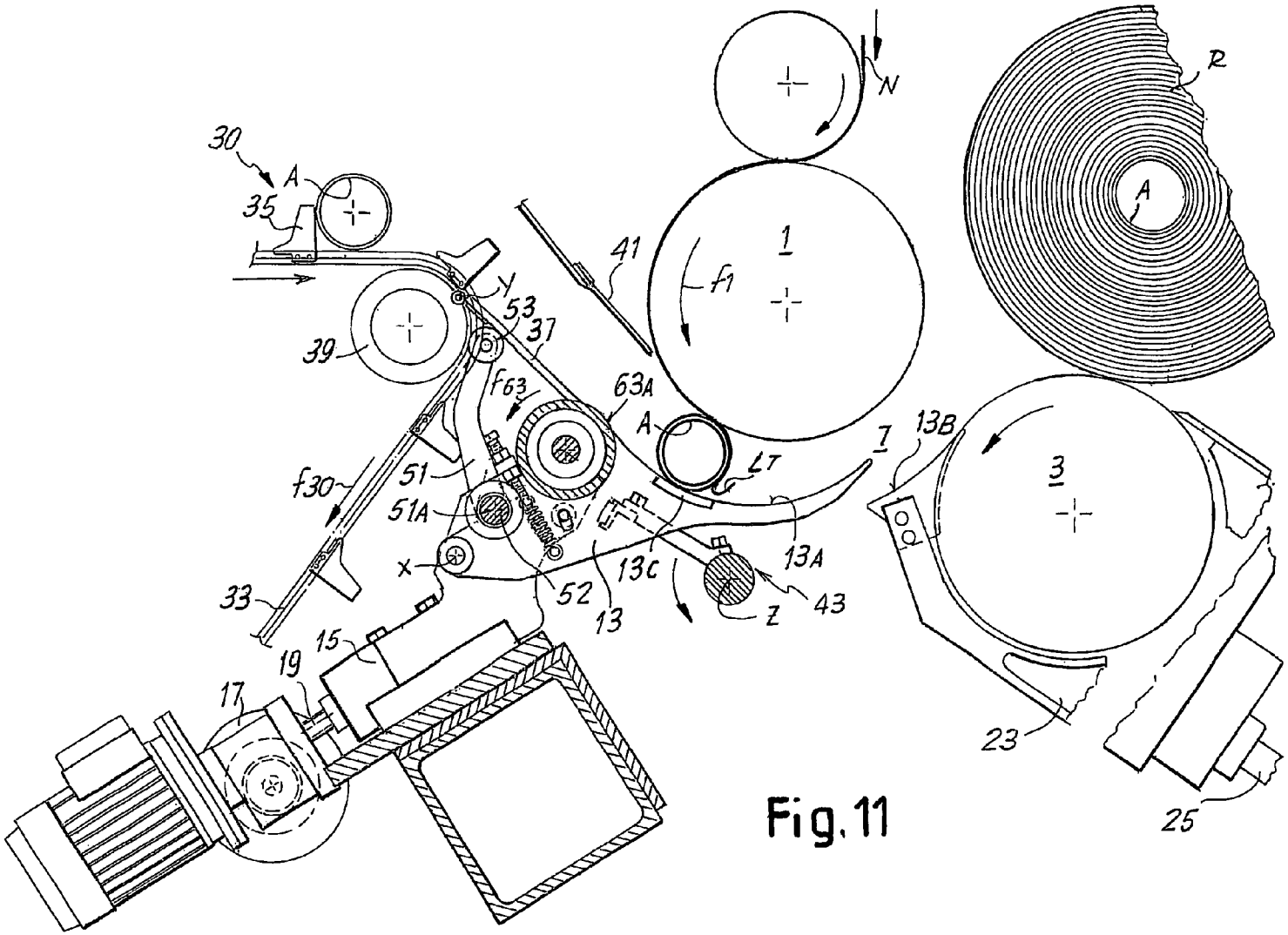

FIG. 9 to 11 show a further embodiment of the invention. The same reference numbers indicate parts that are the same with respect to the embodiment illustrated in FIG. 1 to 8. In this embodiment the severing element 43 is provided with a movement in the opposite direction with respect to the one described in the preceding embodiment example. FIG. 9 shows the initial exchange phase. The element 43 begins to rotate in an anti-clockwise direction (in the example), to enter the channel 11 near its outlet end, i.e. nearest the nip 7. At this moment the new winding core A is retained near the inlet of the channel 11.

Subsequently (FIG. 10), the severing element 43 pinches the web material N against the cylindrical surface of the winding roller 1. In the pinching phase, in the contact area between material N, roller 1 and element 43, the roller 1 has a surface speed directed in the opposite direction with respect to the surface speed of the pressure devices 43A of the severing element 43. The latter, therefore, not only slows down the web material N, but tends to push it towards the inlet of the channel 11. In so doing, the web material, after formation of the leading edge $L_T$ and trailing edge $L_C$, is more easily detached from the cylindrical surface of the winding roller 1 and can therefore be more easily transferred to the new core.

In a possible embodiment of the invention, the new core A is temporarily retained in the vicinity of the inlet of the channel 11 during this phase, to prevent collision with the severing element 43. For said purpose, according to an advantageous embodiment, the core is kept in contact with the web material N, in turn adhering to the winding roller 1, and with the lower roller 63, the surface speed of which can be controlled in this phase in order to be of the same magnitude but in the opposite direction with respect to the surface speed of the winding roller 1 and therefore of the web material N in the contact area with the new core.

Vice versa, there may be a difference in surface speed between the two elements 63 and 1 such as to move the core A forward in a controlled manner and initially very slowly, again in order to allow the element 43 to move away from the channel 11, avoiding collision with the new core A.

In FIG. 11 the severing element 43 has moved away completely from the channel 11 and the core A can enter said channel and move forward along it, following its normal path.

In general, the above-mentioned operation could also be obtained without the roller 63 or other moving member, to retain the rotating core at the inlet of the channel 11, although the solution described offers a series of advantages, as described above. In a different embodiment the core may be retained for example by means of the flexible blade 41 until the pusher 51, 53 inserts it into the channel 11, synchronized with the movement of the movable severing element 43 to avoid collision.

According to a particular aspect, the present invention provides for a peripheral rewinding machine comprising a winding cradle, a guide element for the web material and a channel for insertion of the winding cores towards the winding cradle. Along said channel a movable element operates to sever the web material, which pinches the web material between the element itself and the guide element, moving during the severing operation in an opposite direction with respect to the forward movement direction of the surface of the guide element in contact with the web material. The new winding core is presented at the channel inlet at each new winding cycle. According to an advantageous embodiment, the movement for insertion of the core in the channel is controlled to prevent a collision between the core and the severing element, which moves along the channel.

FIGS. 9 to 11 show further details that can be adopted also in other embodiments. More specifically, 1A indicates a blower box positioned preferably fixed inside the winding roller 1, roughly along the channel 11. According to an advantageous embodiment the roller 1 has a perforated cylindrical surface. In this way it is possible to blow air under pressure across the cylindrical surface of the roller 1 to facilitate detachment of the leading edge of the web material N and its transfer to the new winding core.

Furthermore, to improve the performance of the machine it is possible to provide transverse surfaces 13C along the channel 11, which increase the contact and pressure area on the cores A, to facilitate adhesion of the head of the web material N in the initial winding phase.

It is understood that the drawing only shows one practical embodiment of the invention, which can vary in the forms and arrangements, without departing from the scope of the concept underlying the invention. Any presence of reference numbers in the attached claims has the sole purpose of facilitating the reading thereof in the light of the preceding description and the accompanying drawings and does not limit in any way the scope of protection defined by the claims.

For example, while in the embodiment illustrated the tubular core A comes simultaneously into contact with the web material N entrained around the roller 1 and with the roller 63, the possibility of configuring the geometry of the elements 1, 63, 37, 41 so that the core, pushed by means of the insertion device formed by the oscillating arms 51 with the idle rollers 53, comes into contact first with the roller 63 and only subsequently with the web material N guided around the winding roller 1 is not excluded. In this way, due also to a higher friction coefficient on the surface of the roller 63 with respect to the flexible blades 41, the core begins to rotate, being angularly accelerated by the roller 63 before touching the web material, until it has a surface speed at the initial point of contact with the web material N equal to or only slightly lower than the forward movement speed of the material N. This makes operation of the machine even more regular and uniform and reduces the formation of creases in the first turns of web material wound on each new core.

The invention claimed is:

1. A rewinding machine for winding web material into logs around tubular cores, comprising:

a tubular core insertion path;

a winding cradle;

a first moving member arranged to be in contact with web material to be wound;

a rolling surface forming, with said first moving member, a channel for passage of tubular cores, said channel extending from an inlet, where a core is inserted into said channel, to an outlet from where the core moves into said winding cradle;

an inserter for inserting said cores into the inlet of said channel; and a second moving member at said inlet of said channel and opposed to said first moving member, the core insertion path passing between said first moving member and said second moving member, and said first moving member and said second moving member being positioned at a distance such that a core inserted between said first moving member and said second moving member is in contact with the second moving member and with the web material entrained around the first moving member, the web material being nipped between the first moving member and the core; wherein speed of the first moving member and speed of the second moving member, at points of contact with the core, are oriented in opposed directions and controlled so as to cause rotation and forward movement of the core into said channel.

2. The rewinding machine as claimed in claim 1, wherein said channel extends from the inlet towards a nip providing access to said winding cradle, said nip being defined by two opposed winding rollers.

3. The rewinding machine as claimed in claim 1, wherein said rolling surface is substantially stationary or oscillating.

4. The rewinding machine as claimed in claim 1, wherein said second moving member comprises a roller, which is driven into rotation.

5. The rewinding machine as claimed in claim 1, wherein said first moving member and said second moving member rotate in concordant directions.

6. The rewinding machine as claimed in claim 1, wherein upstream of said second moving member, along the core insertion path, supports are provided to temporarily retain the tubular cores before insertion of a core between said first moving member and said second moving member.

7. The rewinding machine as claimed in claim 6, wherein said supports, said first moving member and said second moving member are arranged so that the core, which is inserted towards said channel, comes into contact with said second moving member before coming into contact with said web material, said core being angularly accelerated before touching the web material.

8. The rewinding machine as claimed in claim 6, wherein said supports comprise a chute and flexible retaining blades for said tubular cores.

9. The rewinding machine as claimed in claim 6, wherein said inserter acts between said supports to push the core, retained by said supports, into contact with said first moving member and said second moving member.

10. The rewinding machine as claimed in claim 1, further comprising at least one suction inlet to provide a vacuum inside said tubular cores, cooperating with ends of said cores, said cores having a cylindrical surface provided with apertures with fluid connection to an internal cavity placed in a vacuum by said at least one suction inlet.

11. The rewinding machine as claimed in claim 10, comprising two suction inlets, cooperating respectively with two ends of each tubular core.

12. The rewinding machine as claimed in claim 11, wherein said two suction inlets are provided with a straight-line movement.

13. The rewinding machine as claimed in claim 10, wherein said at least one suction inlet is movable such that movement thereof is synchronized with movement of the tubular cores, to accompany the tubular cores over a portion of the insertion path.

14. The rewinding machine as claimed in claim 13, wherein the movement of said at least one suction inlet is controlled by said inserter.

15. The rewinding machine as claimed in claim 1, wherein said first moving member is a first winding roller, around which the web material is guided.

16. The rewinding machine as claimed in claim 15, wherein said winding cradle comprises said first winding roller, a second winding roller, and a third winding roller, the first winding roller and the second winding roller forming therebetween an inlet nip to the winding cradle and said third winding roller being movable to permit growth of a log forming in said winding cradle.

17. The rewinding machine as claimed in claim 1, wherein said second moving member is a plurality of coaxial cylindrical portions, supported by a first common motor-driven shaft.

18. The rewinding machine as claimed in claim 17, wherein said inserter comprises oscillating arms supported by a second motor-driven shaft parallel to said first motor-driven shaft.

19. The rewinding machine as claimed in claim 18, wherein said oscillating arms comprise idle rollers cooperating with the tubular cores.

20. The rewinding machine as claimed in claim 18, wherein said oscillating arms are curved in order to move close to the first motor-driven shaft.

21. The rewinding machine as claimed in claim 18, wherein said second moving member is supported by said first motor-driven shaft, which is supported by an adjustable slide, in turn supporting at least one element forming at least a portion of said rolling surface, and wherein said second motor-driven shaft is supported by said adjustable slide.

22. The rewinding machine as claimed in claim 1, wherein said second moving member is supported by a first motor-driven shaft supported by an adjustable slide, in turn supporting at least one element forming at least part of said rolling surface.

23. The rewinding machine as claimed in claim 1, further comprising elements for severing the web material, acting on the web material in a position downstream of said second moving member.

24. The rewinding machine as claimed in claim 23, wherein said elements for severing the web material comprise a moving device cooperating with said first moving member to pinch the web material against said first moving member, wherein during contact with the web material, the moving device moves at a different speed than that of the first moving member.

25. The rewinding machine as claimed in claim 24, wherein during contact with the web material, the moving device moves at a lower speed than that of the first moving member.

26. The rewinding machine as claimed in claim 24, wherein said moving device is arranged to obtain, during contact with said web material, a speed oriented in an opposite direction with respect to a forward movement speed of the web material.

27. The rewinding machine as claimed in claim 1, wherein said first moving member is combined with a device for blowing air under pressure to facilitate detachment of the web material and engagement thereof on a new winding core.

28. A method for winding a web material around tubular winding cores, comprising:

feeding a web material around a first moving member towards a winding cradle;

winding a pre-determined quantity of web material around a first winding core to form a log;

severing the web material at completion of winding of said log, a second winding core being inserted in a channel for passage of cores defined between a rolling surface and said first moving member, said channel extending between a channel inlet and a channel outlet, the second core being moved along said channel from said channel inlet towards said channel outlet towards said winding cradle;

wherein angular acceleration and forward movement of said second winding core in said channel is provided by bringing said second core into contact with the web material guided around said first moving member and with a second moving member arranged at the channel inlet; at points of contact with said second core speeds of the first moving member and the second moving member are oriented in opposed directions and arranged to cause rotation and forward movement of the second core.

29. The method as claimed in claim 28, wherein said second moving member comprises a roller driven into rotation.

30. The method as claimed in claim 28, wherein said first moving member and said second moving member are arranged to rotate in concordant directions.

31. The method as claimed in claim 28, further comprising:

setting said second core to a waiting position, upstream of said second moving member;

pushing said second core from said waiting position to a position of simultaneous contact with said first moving member and said second moving member;

angularly accelerating said second core and causing said second core to move forward in a controlled manner in said channel.

32. The method as claimed in claim 28, wherein said second moving member is operated at a surface speed lower than a speed of the forward movement of the web material and surface speed of the first moving member.

33. The method as claimed in claim 32, wherein said second moving member has a surface speed at least 10% lower than the speed of the forward movement of the web material.

34. The method as claimed in claim 28, wherein said second core is angularly accelerated by said second moving member before said second core contacts said web material.

35. The method as claimed in claim 28, wherein said first moving member is a winding roller, around which the web material is guided.

36. The method as claimed in claim 28, further comprising blowing compressed air between said first moving member and the web material to facilitate detachment of the web material from the first moving member and transfer thereof to the second core.

37. The method as claimed in claim 28, wherein said web material is severed by a movable severing element, pinching the web material between said movable severing element and a guide element of the web material.

38. The method as claimed in claim 37, wherein said guide element of the web material is the first moving member.

39. The method as claimed in claim 37, wherein during said pinching of the web material, said movable severing element has a different speed from speed of said guide element of the web material.

40. The method as claimed in claim 39, wherein said movable severing element has a speed oriented in an opposite direction with respect to speed of said first moving member.

* * * * *